US009885145B2

(12) United States Patent
Bae et al.

(10) Patent No.: US 9,885,145 B2
(45) Date of Patent: Feb. 6, 2018

(54) LAUNDRY DRYING APPARATUS

(71) Applicant: LG Electronics Inc., Seoul (KR)

(72) Inventors: Sanghun Bae, Seoul (KR); Hongjun Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 586 days.

(21) Appl. No.: 14/155,983

(22) Filed: Jan. 15, 2014

(65) Prior Publication Data

US 2015/0020399 A1 Jan. 22, 2015

(30) Foreign Application Priority Data

Jul. 16, 2013 (KR) ..... 10-2013-0083684

(51) Int. Cl.

| | |
|---|---|
| ***F26B 19/00*** | (2006.01) |
| ***D06F 58/24*** | (2006.01) |
| ***D06F 58/22*** | (2006.01) |
| ***D06F 58/04*** | (2006.01) |
| ***D06F 58/20*** | (2006.01) |
| *D06F 39/12* | (2006.01) |

(52) U.S. Cl.
CPC ..... *D06F 58/24* (2013.01); *D06F 58/04* (2013.01); *D06F 58/20* (2013.01); *D06F 58/22* (2013.01); *D06F 39/12* (2013.01)

(58) Field of Classification Search
CPC ..... D06F 58/24; D06F 58/22; D06F 58/02
USPC ..... 34/82, 130, 595, 602, 603, 242, 667
See application file for complete search history.

(56) References Cited

U.S. PATENT DOCUMENTS

| | | | | |
|---|---|---|---|---|
| 2,813,414 | A * | 11/1957 | Johnston | D06F 25/00 34/596 |
| 4,665,628 | A * | 5/1987 | Clawson | D06F 58/02 34/131 |
| 8,112,904 | B2 | 2/2012 | Kono et al. | |
| 8,631,527 | B2 * | 1/2014 | Ashrafzadeh | D06F 39/003 68/139 |
| 8,789,288 | B2 * | 7/2014 | Lim | D06F 29/00 34/215 |
| 8,875,416 | B2 * | 11/2014 | Anderson | D06F 58/04 34/603 |
| 2004/0159009 | A1 | 8/2004 | Hwang | |
| 2010/0024239 | A1 * | 2/2010 | Kono | D06F 25/00 34/76 |
| 2011/0265524 | A1 | 11/2011 | Kim et al. | |
| 2012/0011738 | A1 | 1/2012 | Ashrafzadeh et al. | |

(Continued)

FOREIGN PATENT DOCUMENTS

| | | | |
|---|---|---|---|
| CN | 101517146 | A | 8/2009 |
| CN | 101748583 | A | 6/2010 |
| CN | 102747589 | A | 10/2012 |

(Continued)

*Primary Examiner* — John McCormack
(74) *Attorney, Agent, or Firm* — Dentons US LLP

(57) ABSTRACT

A laundry drying apparatus having a cabinet including a front panel with an opening for introduction and removal of laundry, a drying drum horizontally installed within the cabinet, and an air supply device to collect air from inside the drying drum, direct the air through ducts, and then return the air into the drying drum. The front panel includes an upper region where a door is installed and a lower region located below the upper region, and the upper region is tilted rearward by a predetermined tilt angle.

14 Claims, 6 Drawing Sheets

(56) References Cited

U.S. PATENT DOCUMENTS

2012/0144687 A1* 6/2012 Yeom ..... D06F 58/22
34/82

FOREIGN PATENT DOCUMENTS

| | | | |
|---|---|---|---|
| CN | 102884244 | A | 1/2013 |
| DE | 3213420 | A1 | 10/1983 |
| EP | 2423375 | A1 | 2/2012 |
| EP | 2610391 | A1 | 7/2013 |
| FR | 2736942 | A1 | 1/1997 |

* cited by examiner

LAUNDRY DRYING APPARATUS

This application claims the benefit of Korean Patent Application No. 10-2013-0083684, filed on Jul. 16, 2013, which is hereby incorporated by reference as if fully set forth herein.

BACKGROUND

Field

The present disclosure relates to a laundry drying apparatus and more particularly, to a laundry drying apparatus having an improved laundry introduction and removal configuration, thereby achieving enhanced user convenience.

Discussion of the Related Art

A laundry treatment apparatus typically includes a washing machine for washing laundry and a drying apparatus for drying laundry.

A drying apparatus is a home appliance that dries completely washed laundry, e.g., clothing, using hot air. Generally, the drying apparatus includes a laundry vessel in which laundry is received. Dry air is fed into the laundry vessel and wet air inside the laundry vessel is exhausted, drying the laundry.

Such a drying apparatus may be divided into a top loading type drying apparatus and a front loading type drying apparatus according to a method of introducing laundry into the drying apparatus. In the top loading type drying apparatus, laundry is introduced through the top of the drying apparatus. In the front loading type drying apparatus, laundry is introduced through the front side of the drying apparatus.

Further, the drying apparatus may be divided into a condensation type drying apparatus in which air used to dry laundry is circulated, and an exhaust type drying apparatus in which air used to dry laundry is discharged from the drying apparatus.

In the condensation type drying apparatus, humid air heat-exchanged with laundry in a drum is circulated rather than being discharged from the drying apparatus, and then exchanges heat with outside air in a condenser, thus causing condensed water to be discharged. In the exhaust type drying apparatus, humid air heat-exchanged with laundry in a drum is directly discharged from the drying apparatus.

In the condensation type drying apparatus as described above, air used to dry an object, such as laundry, collects lint from the laundry. The lint is caught by a lint filter that is installed in a path of air to be discharged from the drum.

Hereinafter, a laundry drying apparatus according to the related art will be described in detail with reference to FIG. 1. FIG. 1 is a schematic view showing an internal configuration of a laundry drying apparatus according to the related art.

The laundry drying apparatus according to the related art, designated by reference numeral 10, includes a cabinet 20 defining an external appearance of the drying apparatus 10, a drying drum 30 rotatably placed within the cabinet 20, an air supply device 50 that supplies dry air into the drying drum 30 and then collects and circulates the air, and a drive unit 40 that supplies and transmits power to the drying drum 30 and the air supply device 50.

A door 21 is installed to the front side of the cabinet 20 such that an object to be dried, i.e. laundry, is introduced into and removed from the drying drum 30 through the open door 21.

The door 21 is provided with a door glass 22 to allow a user to view a drying process within the drying drum 30. In FIG. 1, the door glass 22 is configured to protrude inward of the drum 30, in order to prevent laundry inside the drying drum 30 from moving toward the door 21 during drying of laundry.

The drying drum 30 is a cylindrical drum defining a drying space therein. The drying drum 30 has a front opening 31 for introduction and removal of laundry and a rear air supply port 32 through which air is supplied from the air supply device 50.

The air supply device 50 is located below a front end of the drying drum 30 and is configured to collect and heat air inside the drying drum 30, and thereafter to supply the heated air through a rear end of the drying drum 30.

The above-described air supply device 50 includes a blowing fan 54 configured to cause movement of air, a collection duct 52 located at the front end of the drying drum 30 to collect air from the drum 30, a heating duct 55 connected to the collection duct 52 to heat air, and a condensation duct 56 connected to the heating duct 55 to condense moisture contained in air.

The drive unit 40 transmits power for operation of the drying drum 30 as well as the air supply device 50. The drive unit 40 includes a motor 41, and a power transmission member 42 (e.g., a belt and a pulley) configured to transmit rotational power of the motor 41 to the drying drum 30. The blowing fan 54 may be directly connected to the motor 41 to receive power from the motor 41.

A lint filter 60 is provided in the collection duct 52 of the air supply device 50 and serves to catch lint contained in the air collected from the drying drum 30. In consideration of a structural feature shown FIG. 1, the lint filter 60 must be located in front of the drying drum 30. To remove the caught lint through the open door 21, the lint filter 60 is separably mounted in the collection duct 52.

In the case of the laundry drying apparatus 10 according to the related art as described above, the drying drum 30 and the blowing fan 54 are configured to be driven by the single motor 41. To this end, the drying drum 30 is typically horizontally installed. Generally, the drying drum 30 is horizontally installed to allow air to uniformly pass through laundry as an object to be dried.

In the case in which the drying drum 30 is horizontally installed, the door 21 configured to open or close the drying drum 30 is typically vertically installed to open or close the opening 31 of the drying drum 30. In this case, the user who tries to introduce or remove laundry must bend at the waist, which may cause user inconvenience.

Additionally, the lint filter 60 is located between the horizontally installed drying drum 30 and the vertically installed door 21. In this case, the door glass 22 of the door 21 may clog an air path extending from the drying drum 30 to the lint filter 60.

Further, when the drying drum 30 is rotated during drying of laundry, laundry may jam between the door glass 22 and the lint filter 60. The jammed laundry may clog an air collection path extending through the collection duct 52 and the lint filter 60, and may prevent rotation of the drying drum 30.

SUMMARY

Accordingly, embodiments of the present invention are directed to a laundry drying apparatus that substantially obviates one or more problems due to limitation and disadvantages of the related art.

One object of the present invention is to provide a laundry drying apparatus in which a door of the laundry drying apparatus is tilted to allow a user to bend less at the waist when introducing and removing laundry, which may improve user access to laundry.

Another object of the present invention is to provide a laundry drying apparatus in which a door of the laundry drying apparatus is tilted to provide an installation space for a lint filter interposed between the door and a drum and to ensure easy separation and coupling of the lint filter.

A further object of the present invention is to provide a laundry drying apparatus in which a door of the laundry drying apparatus is tilted to achieve a path for a lint filter interposed between the door and a drum.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the present invention, as embodied and broadly described herein, a laundry drying apparatus includes a cabinet including a front panel with an opening for introduction and removal of laundry, a drying drum horizontally installed within the cabinet, and an air supply device o collect air from inside the drying drum, direct the air through ducts, and then return the air into the drying drum, wherein the front panel includes an upper region where a door is installed and a lower region located below the upper region, and wherein the upper region is tilted rearward by a predetermined tile angle.

The door installed at the upper region may be tilted by an angle corresponding to the predetermined tilt angle of the upper region. The predetermined tilt angle of the upper region may be within a range of 10~14 degrees.

The lower region may be indented inward of the front panel with respect to the upper region, and a seam portion between the upper region and the lower region may protrude forward of the front panel.

The drying drum may include a cylindrical drum body, a front plate configured to rotatably support a front end of the drum body, and a rear plate configured to rotatably support a rear end of the drum body.

The front plate may protrude toward the front panel and may include an inclined aperture connected to the opening formed in the front panel of the cabinet.

The air supply device may include a collection duct coupled to a lower side of the inclined aperture, a blowing fan positioned within the collection duct to move air, a heating duct coupled to the blowing fan to heat the moved air, and a condensation duct to supply the heated air into the drying drum through the rear plate.

A lint filter mount may be formed at the lower side of the inclined aperture.

A lint filter which is mounted on the lint filter mount may be located inside the collection duct when mounted to the lint filter mount.

An air collector may be formed below the inclined aperture such that the drying drum communicates with the lint filter.

The door may include a door glass protruding toward the drying drum, and an anti-jamming member may be provided on the inclined aperture to prevent laundry from jamming in a gap between the inclined aperture and the door glass.

The anti jamming member may have a crescent shape and may extend from an inner lower portion of the inclined aperture to both sides of an upper portion of the inclined aperture.

The laundry drying apparatus may further include an auxiliary device provided below the cabinet to increase the height of the cabinet.

The auxiliary device may include a housing to support the cabinet and to define a space therein, and a drawer receivable in the housing so as to be drawn forward of the cabinet.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the present invention and are incorporated in and constitute a part of this application, illustrate embodiment(s) of the invention and together with the description serve to explain the principle of the invention. In the drawings.

DETAILED DESCRIPTION

In the following description of the present invention, the terms for respective components are defined taking into consideration the functions obtained in accordance with the present invention. Accordingly, the definitions of these terms should not be understood as meanings that restrict technical components of the present invention. In addition, the terms for respective components may be replaced by other terms of the art.

Hereinafter, a laundry drying apparatus according to one embodiment of the present invention will be described in detail with reference to the accompanying drawings.

Figure 2:
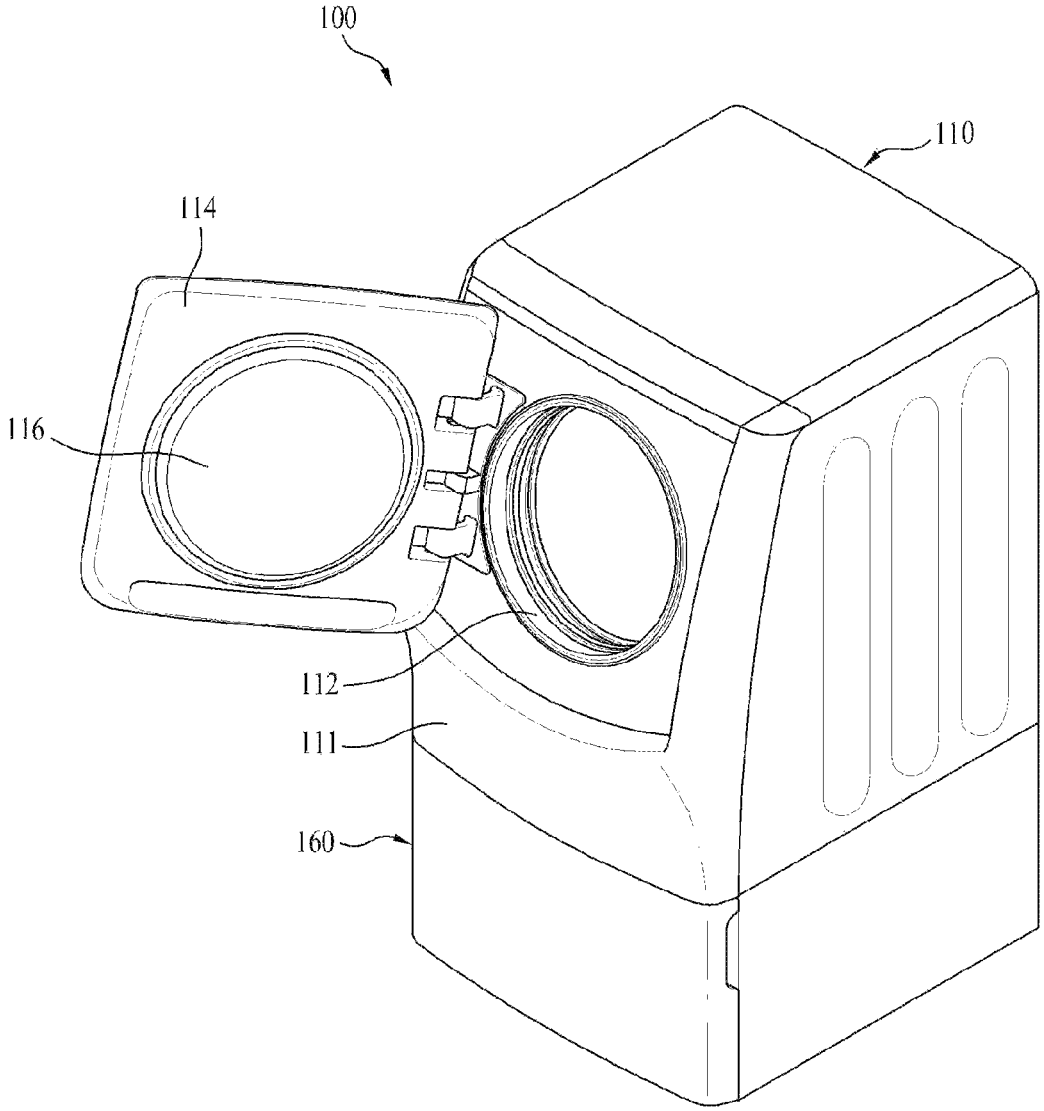
FIG. 2 is a perspective view showing a laundry drying apparatus according to one embodiment of the present invention.
Figure 3:
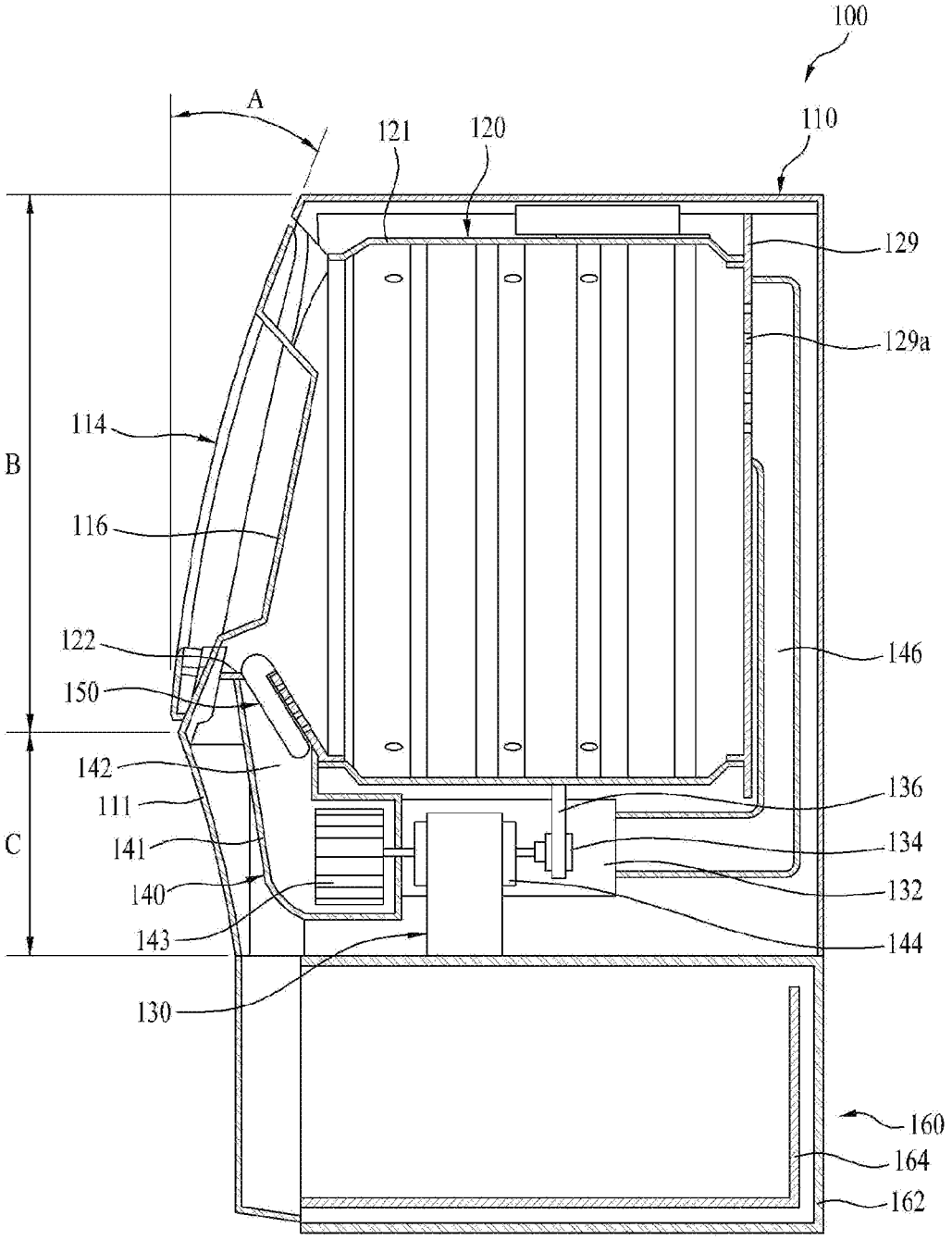
FIG. 3 is a sectional view showing an internal configuration of the laundry drying apparatus according to one embodiment of the present invention.

As exemplarily shown in FIGS. 2 and 3, the laundry drying apparatus according to the present invention, designated by reference numeral 100, includes a cabinet 110 defining an external appearance of the apparatus 100 and having a door 114 for introduction and removal of an object to be dried, e.g., laundry, a drying drum 120 rotatably placed within the cabinet 110, an air supply device 140 that supplies heated hot air into the drying drum 120, and a drive unit 130 that supplies rotational power to drive the drying drum 120 and the air supply device 140.

In addition, the laundry drying apparatus 100 according to the present invention may further include an auxiliary device 160 configured to increase the height of the laundry drying apparatus 100.

The auxiliary device 160 may be configured to allow the laundry drying apparatus 100 to be seated thereon. To this end, the auxiliary device 160 may have a shape corresponding to the external appearance of the laundry drying apparatus 100. The auxiliary device 160 will be described in detail after completing explanation of the laundry drying apparatus 100.

The cabinet 110 defines the external appearance of the laundry drying apparatus 100. The cabinet 110 is constructed by a front panel 111 that defines the front side of the laundry drying apparatus 100, the door 114 being pivotally rotatably coupled to the front panel 111, and lateral panels (not shown), a top panel (not shown), and a rear panel (not shown) which respectively define both lateral sides, top side, and rear side of the cabinet 110.

In these embodiments, the lateral panel, the top panel, and the rear panel have the same configuration as a lateral panel, a top panel, and a rear panel of the related art. Note that only the front panel 111 has a different configuration from a front panel of the related art.

Figure 1:
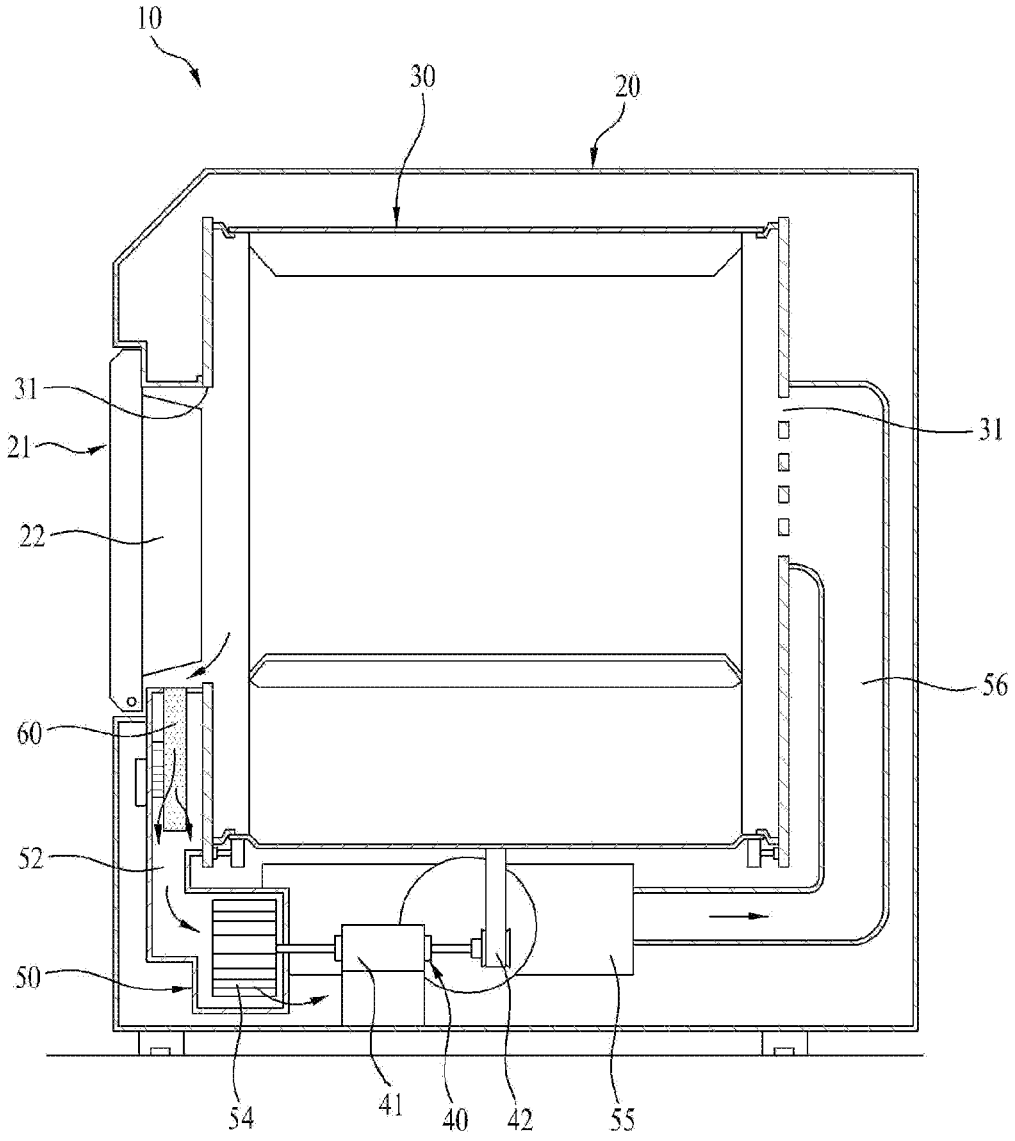
FIG. 1 is a schematic view showing a laundry drying apparatus according to the related art.

Meanwhile, as shown in FIG. 1, in the case of the laundry drying apparatus 10 according to the related art, the drum 30 is horizontally installed such that the opening 31 of the drum 30 is defined in a vertical plane.

As such, the door 21 used to open or close the opening 31 of the drum 30 must be vertically installed so as to be pivotally rotated about a vertical axis corresponding to the opening 31 of the drum 30. Therefore, the front panel of the laundry drying apparatus 10 according to the related art is installed in a vertical plane.

Conversely, in the case of the front panel 111 of the laundry drying apparatus 100 according to the present invention, as shown in FIG. 3, the door 114 coupled to the front panel 111 is tilted by a predetermined angle A.

The door 114 may be installed with an angle ensuring that an upper portion of the door 114 is tilted rearward of the laundry drying apparatus 100. In this case, the tilting angle of the door 114 may be within a range of 10~14 degrees, and more particularly, about 12 degrees.

In the case in which the door 114 is tilted as described above, a user may bend less at the waist when introducing or removing laundry as compared to the case in which the door 114 is vertically installed, as in the related art, which may increase user convenience.

As exemplarily shown in FIG. 3, the front panel 111 may be divided into an upper region B where the door 114 is installed, and a lower region C. The upper region B is tilted by the angle A similar to the door 114 for installation of the door 114 to the upper region B as described above.

The lower region C located below the upper region B may be vertically defined differently from the upper region B, or may have a symmetrical shape of the upper region B.

More specifically, if the lower region C is tilted in the same direction as that of the upper region B, the laundry drying apparatus 100 may have an excessively protruding lower portion, which may make it difficult for the user to access the laundry drying apparatus 100. Therefore, the lower region C may be tilted in a direction opposite to a tilting direction of the upper region B (i.e., lower region C may be tilted downward and inward of the laundry drying apparatus 100).

In summary, the front panel 111 of the laundry drying apparatus 100 according to the present invention consists of the upper region B where the door 114 is installed and the lower region C located below the upper region B, a seam portion between the upper region B and the lower region C protrudes outward from the laundry drying apparatus 100, an upper end of the upper region B is tilted inward of the laundry drying apparatus 100, and a lower end of the lower region C is tilted inward of the laundry drying apparatus 100.

In this way, the lower region C may provide a space to allow the user to access the laundry drying apparatus 100, and both the upper region B and the door 114 installed to the upper region B may allow the user to easily introduce and remove laundry.

Meanwhile, the upper region B of the front panel 111 is provided with an opening 112 for introduction of laundry, and the door 114 is coupled to one side of the opening 112.

Here, the door 114 is provided at the center thereof with a door glass 116 to allow the user to view the interior of the drying drum 120. The door glass 116 is configured to protrude inward of the drying drum 120.

Here, the door 114 installed to the front panel 111 is coupled to the front panel 111 via a hinge device (not shown). The hinge device may provide a predetermined magnitude of repulsive elasticity upon opening and closing of the door 114.

More specifically, as the door 114 installed to the front panel 111 is tilted by the predetermined angle A, the door 114 may be forcibly rotated by the weight of the door 114 upon opening or closing of the door 114. The repulsive elasticity of the hinge device may prevent the door 114 from being forcibly rotated by the weight of the door 114.

Figure 4:
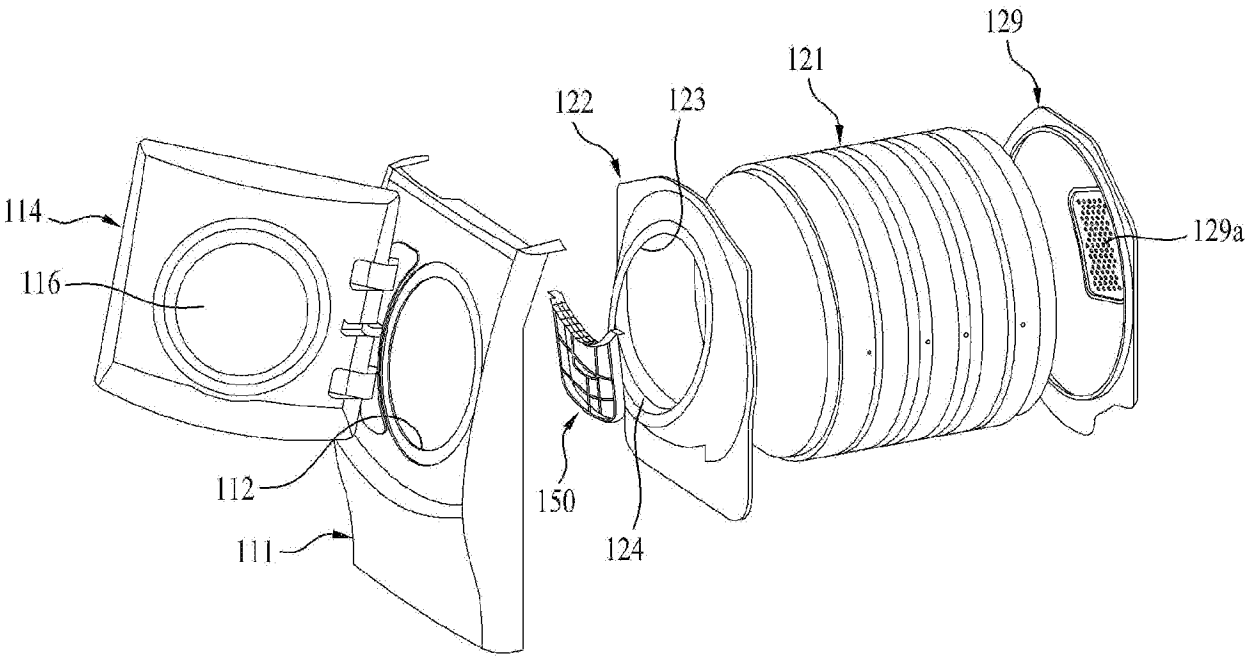
FIG. 4 is an exploded perspective view showing important parts of the laundry drying apparatus according to one embodiment of the present invention.

The drying drum 120, as exemplarily shown in FIGS. 3 and 4, is rotatably placed within the cabinet 110. The drying drum 120 includes a rotatably supported cylindrical drum body 121, a front plate 122 coupled to a front end of the drum body 121 to rotatably support the front end of the drum body 121, and a rear plate 129 coupled to a rear end of the drum body 121 to rotatably support the rear end of the drum body 121.

In addition to rotatably supporting the front end of the drum body 121, the front plate 122 of the drying drum 120 serves to connect the drum body 121 to the opening 112 of the front panel 111.

Figure 5:
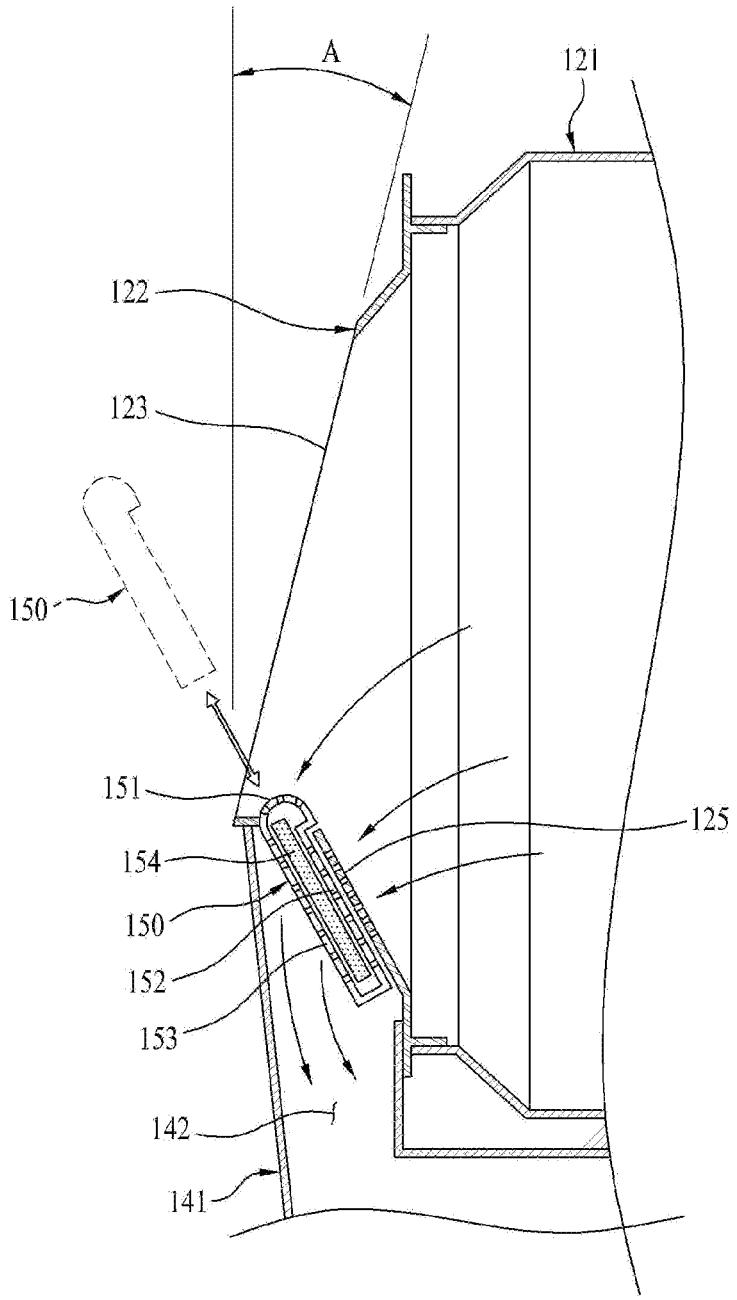
FIG. 5 is a partial sectional view showing important parts of the laundry drying apparatus according to one embodiment of the present invention.

Referring to FIG. 5, the front panel 111 is tilted by the predetermined angle A as described above, whereas the front end of the drum body 121 of the drying drum 120 is defined in a vertical plane.

Accordingly, the top of the opening 112 of the front panel 111 is located proximate to the top of the front end of the drum body 121, whereas the bottom of the opening 112 of the front panel 111 is spaced apart from the bottom of the front end of the drum body 121 by a predetermined distance. That is, the opening 112 of the front panel 111 and the front end of the drum body 121 are spaced apart from each other in a non-parallel state.

Accordingly, one surface of the front plate 122 that faces the drum body 121 defines a vertical surface corresponding to the drum body 121 so as to rotatably support the drum body 121, whereas the other surface of the front plate 122 that faces the front panel 111 is a obliquely protruding surface having the predetermined inclination angle A.

More specifically, the front plate 122 takes the form of a conical plate, the center of which protrudes toward the front panel 111, and is provided at a pointed end thereof with an inclined aperture 123 that comes into contact with the opening 112 of the front panel 111.

Here, a lint filter mount 124, on which a lint filter 150 that will be described hereinafter is mounted, is formed at a lower portion of an inner surface of the inclined aperture 123. A collection duct 141 of the air supply device 140 that will be described hereinafter is connected to a position below and at the outside of the inclined aperture 123. The lint filter 150 and the air supply device 140 will be described in detail later.

The lint filter 150 mounted on the lint filter mount 124 is upwardly exposed. Thereby, as air inside the drying drum 120 is moved into the collection duct 141 by way of the lint filter 150, lint contained in the air is caught by the lint filter 150.

Here, considering a configuration of the lint filter 150, as exemplarily shown in FIG. 5, the lint filter 150 includes a housing defining a space therein, and a filter 154 located inside the housing. The housing has a top inlet 151 and a lateral inlet 152 respectively formed in a top surface and one lateral surface thereof for introduction of air inside the drying drum 120, and an outlet 153 formed in the other lateral surface thereof for discharge of air filtered by the filter 154.

The above-described lint filter 150 is separably mounted to the lint filter mount 124 of the front plate 122, and is obliquely installed by a predetermined angle so as to be removed through the inclined aperture 123.

An air collector 125 in the form of a plurality of through-holes may further be formed in the front plate 122 at a position proximate to the lint filter mount 124 to guide introduction of air inside the drying drum 120 into the lateral inlet 152 of the lint filter 150. Provision of the air collector 125 may increase the quantity of air to be introduced into the lint filter 150, thereby enhancing filtering efficiency of the lint filter 150.

Meanwhile, when viewed from the interior of the drying drum 120, the inclined aperture 123 of the front plate 122 is indented toward the door 114, and the door glass 116 of the door 114 protrudes from the inclined aperture 123 into the drying drum 120. As such, a circular or elliptical gap D is defined between an inner peripheral surface of the inclined aperture 123 and an outer peripheral surface of the door glass 116.

In one embodiment, the gap D between an inner upper portion of the inclined aperture 123 and an upper portion of the door glass 116 is relatively small, and the gap D between an inner lower portion of the inclined aperture 123 and a lower portion of the door glass 116 is relatively large.

The gap D between the inner peripheral surface of the inclined aperture 123 and the door glass 116, however, may cause laundry to jam between the inner peripheral surface of the inclined aperture 123 and the door glass 116 during rotation of the drying drum 120, which may prevent efficient rotation of the laundry. Inefficient rotation of the laundry prevents air supplied into the drying drum 120 from efficiently coming into contact with the laundry, resulting in insufficient drying of the laundry.

However, the gap D between the inner upper portion of the inclined aperture 123 and the upper portion of the door glass 116 is relatively small, and the laundry may be easily released from the relatively small gap D by the weight of the laundry. But, with regard to the gap D between the inner lower portion of the inclined aperture 123 and the lower portion of the door glass 116, it is necessary to prevent jamming of the laundry because the laundry tends to be collected on the bottom of the drying drum 120 due to gravity.

Accordingly, an anti jamming member 126 may be provided at the inner lower portion of the inclined aperture 123 to prevent laundry from jamming between the inner lower portion of the inclined aperture 123 and the lower portion of the door glass 116.

Here, the anti-jamming member 126 is installed to a lower portion of the inner peripheral surface of the inclined aperture 123 to reduce the gap D between the inner lower portion of the inclined aperture 123 and the lower portion of the door glass 116, thereby preventing laundry from jamming between the inner lower portion of the inclined aperture 123 and the lower portion of the door glass 116.

Figure 6:
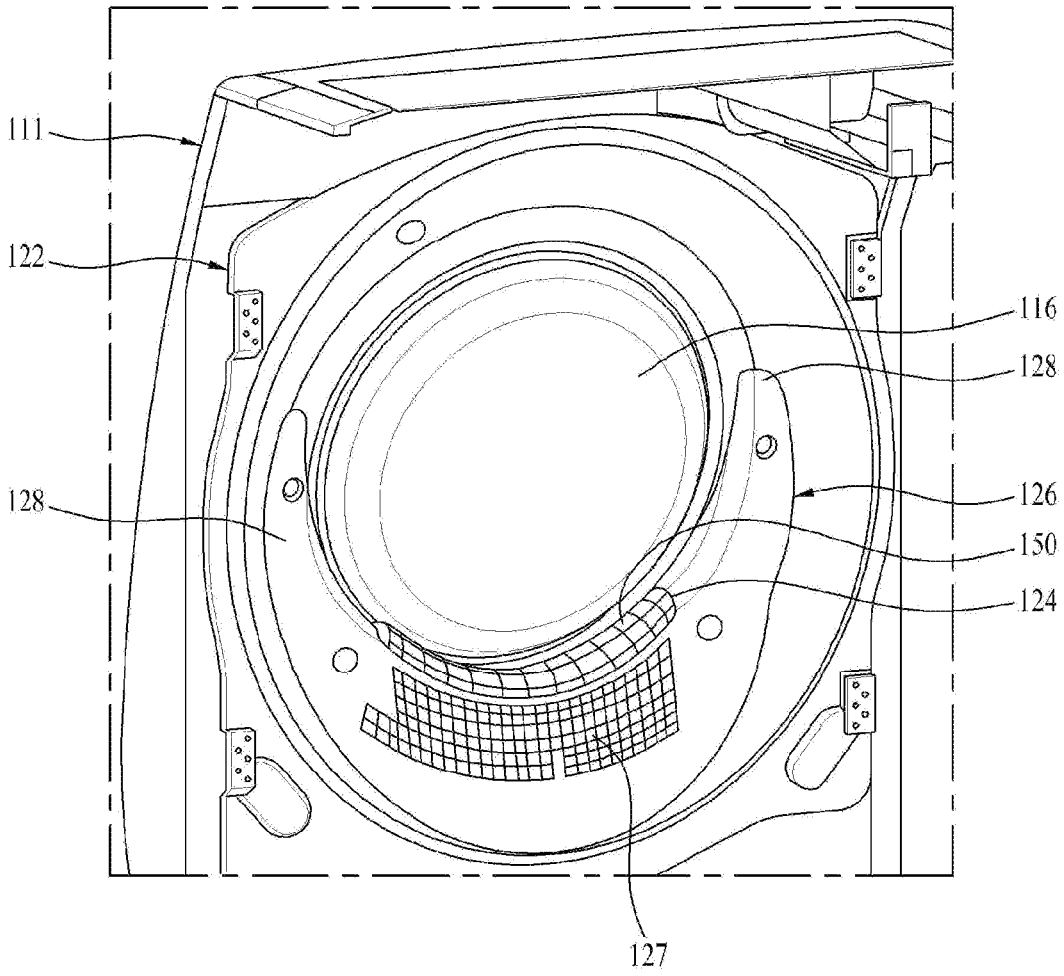
FIG. 6 is a rear perspective view showing important parts of the laundry drying apparatus according to one embodiment of the present invention.

The anti jamming member 126 will hereinafter be described with reference to FIG. 6. As shown, one surface of the anti jamming member 126 has a shape corresponding to the shape of the inner lower portion of the inclined aperture 123 and the other surface of the anti jamming member 126 is an inclined surface that is relatively similar to a vertical surface.

More specifically, in the case of the circular or elliptical gap D between the inclined aperture 123 and the door glass 116, a lower end of the gap D has the greatest width, and the width of the gap D is gradually reduced upward. Accordingly, the anti-jamming member 126 has a shape having a wide lower end and the width of the anti-jamming member 126 is gradually reduced toward both sides of an upper end thereof. More specifically, the anti jamming member 126 has a crescent shape.

Additionally, the anti jamming member 126 centrally has a plurality of through-holes 127 that may communicate with the air collector 125 formed at the inclined aperture 123. Both lateral sides of the anti jamming member 126 are provided with extensions 128 which protrude along both lateral sides of the inner peripheral surface of the inclined aperture 123.

Meanwhile, the rear plate 129 of the drying drum 120 serves not only to rotatably support the rear end of the drum body 121, but also to supply air supplied from the air supply device 140 into the drum body 121.

The rear plate 129 has a plurality of air supply holes **129*a* formed in a predetermined portion thereof, and a condensation duct 146 of the air supply device 140 is installed at the outside of the rear plate 129 to communicate with the air supply holes 129*a*** for supply of air.

A front support member (not shown) and a rear support member (not shown), are respectively provided at inner surfaces of the front plate 122 and the rear plate 129 opposite to each other. The front support member and the rear support member take the form of rollers to rotatably support the drum body 121 located between the front plate 122 and the rear plate 129. Various embodiments of the front support member and the rear support member may be proposed, and a detailed description of this is omitted herein.

The drive unit 130 serves to drive the drum body 121 of the drying drum 120 and a blowing fan 143 of the air supply device 140 that will be described hereinafter. The drive unit 130 includes a motor 132 to provide rotational power.

Here, the blowing fan 143 of the air supply device 140 is connected to one end of a rotating shaft of the motor 132, and a pulley 134 is provided at the other end of the rotating shaft to transmit rotational power to the drying drum 120. The pulley 134 and the drum body 121 of the drying drum 120 are connected to each other via a belt 136 and are adapted to receive rotational power of the motor 132.

As the motor 132 of the drive unit 130 is rotated, the drum body 121 of the drying drum 120 and the blowing fan 143 of the air supply device 140 may be operated in linkage to each other. Alternatively, the drying drum 120 and the blowing fan 143 may be driven individually using different motors. Various embodiments of the drive unit 130 may be proposed, and thus a detailed description of this is omitted herein.

The air supply device 140, as exemplarily shown in FIG. 2, serves to collect and heat air inside the drying drum 120 and supply the heated air into the drying drum 120. The air supply device 140 includes the collection duct 141 connected to the front plate 122 of the drying drum 120 to collect air inside the drying drum 120, the blowing fan 143 connected to the collection duct 141 to move air, a heating duct 144 in which a heater (not shown) to heat the air moved by the blowing fan 143 is provided, and the condensation duct 146 that condenses moisture of the air heated in the heating duct 144 to generate heated dry air and guide the same into the drying drum 120.

Here, the collection duct 141 is connected to an outer lower portion of the front plate 122 of the drying drum 120. More specifically, the collection duct 141 is connected to a portion below the lint filter mount 124 provided at the inclined aperture 123. Accordingly, the collection duct 141 provides a lint filter space 142 in which the lint filter 150 mounted to the lint filter mount 124 is received.

Although the above-described embodiment of the air supply device 140 exemplifies a circulation type air supply device, an exhaust type air supply device may be applied to the present invention. In addition, although the air supply device using the heater has been described above, an air supply device using a heat pump that heats air using refrigerant may be applied to the present invention.

The auxiliary device 160 serves to raise the height of the laundry drying apparatus 100 in order to provide the laundry drying apparatus 100 with enhanced user convenience. The auxiliary device 160 includes a housing 162 that is configured to support the laundry drying apparatus 100 and defines an inner space, and a drawer 164 provided inside the housing 162 so as to be drawn forward of the laundry drying apparatus 100.

Here, a washing device (not shown) for washing laundry may be provided in the drawer 164. Alternatively, the drawer 146 may provide a separate drying space. Various embodiments of the auxiliary device 160 may be proposed, and thus a detailed description of this is omitted herein.

As is apparent from the above description, in a laundry drying apparatus according to one embodiment of the present invention, a door of the laundry drying apparatus is tilted to improve user access to laundry so as to allow the user to bend less at the waist when introducing and removing laundry, which results in enhanced user convenience.

Further, in a laundry drying apparatus according to one embodiment of the present invention, a door of the laundry drying apparatus is tilted and a lint filter is mounted in a space between a lower portion of the door and a drum, which enables easy separation and coupling of the lint filter.

Furthermore, in a laundry drying apparatus according to one embodiment of the present invention, a door of the laundry drying apparatus is tilted and a lint filter is mounted in a space between a lower portion of the door and a drum, which ensures a greater path of air to be introduced into the lint filter, resulting in reduced air resistance in the path.

It will be apparent that, although the preferred embodiments have been shown and described above, the invention is not limited to the above-described specific embodiments, and various modifications and variations can be made by those skilled in the art without departing from the scope of the appended claims.

What is claimed is:

1. A laundry drying apparatus, comprising:

a cabinet including a front panel with an opening for introduction and removal of laundry and a door for opening and closing the opening;

a drying drum horizontally installed within the cabinet;

an air supply device to collect air from inside the drying drum, direct the air through ducts, and then return the air into the drying drum; and a lint filter mounted in a lower portion of the opening and detachable in an opening direction of the door, the lint filter being inclined downward in a rearward direction, an anti-jamming member provided between the opening and the door, wherein the front panel includes an upper region where the door is installed and a lower region located below the upper region, wherein the upper region is inclined downward in a forward direction by a predetermined tilt angle, and wherein the lint filter includes a top inlet for introducing air through the anti-jamming member and a lateral inlet for introducing air downward in a forward direction through the anti-jamming member.

2. The apparatus of claim 1, wherein the door installed at the upper region is tilted by an angle corresponding to the predetermined tilt angle of the upper region.

3. The apparatus of claim 1, wherein the predetermined tilt angle of the upper region is within a range of 10-14 degrees.

4. The apparatus of claim 1, wherein the lower region is indented inward of the front panel with respect to the upper region, and wherein a seam portion between the upper region and the lower region protrudes forward of the front panel.

5. The apparatus of claim 1, wherein the drying drum includes:

a cylindrical drum body;

a front plate configured to rotatably support a front end of the drum body; and a rear plate configured to rotatably support a rear end of the drum body.

6. The apparatus of claim 5, wherein the front plate protrudes toward the front panel and includes an inclined aperture connected to the opening formed in the front panel of the cabinet.

7. The apparatus of claim 6, wherein the air supply device includes:

a collection duct coupled to a lower side of the inclined aperture;

a blowing fan positioned within the collection duct to move air;

a heating duct coupled to the blowing fan to heat the moved air; and a condensation duct to supply the heated air into the drying drum through the rear plate.

8. The apparatus of claim 7, wherein a lint filter mount is formed at the lower side of the inclined aperture.

9. The apparatus of claim 8, wherein the lint filter is mounted on the lint filter mount and located inside the collection duct.

10. The apparatus of claim 8, wherein an air collector is formed below the inclined aperture such that the drying drum communicates with the lint filter.

11. The apparatus of claim 6, wherein the door includes a door glass protruding toward the drying drum, and wherein the anti-jamming member is provided on the inclined aperture to prevent laundry from jamming in a gap between the inclined aperture and the door glass.

12. The apparatus of claim 11, wherein the anti-jamming member has a crescent shape and extends from an inner lower portion of the inclined aperture to both sides of an upper portion of the inclined aperture.

13. The apparatus of claim 1, further comprising:

an auxiliary device provided below the cabinet to increase the height of the cabinet.

14. The apparatus of claim 13, wherein the auxiliary device includes:

a housing to support the cabinet and to define a space therein; and a drawer receivable in the housing so as to be drawn forward of the cabinet.

* * * * *